US011500307B2

(12) United States Patent
Tsuji

(10) Patent No.: US 11,500,307 B2
(45) **Date of Patent: *Nov. 15, 2022**

(54) TONER CONVEYING DEVICE OF IMAGE FORMING APPARATUS INCLUDING PUSHING MEMBER TO PUSH CONVEYANCE MEMBER FROM DIFFERENT DIRECTIONS

(71) Applicant: KYOCERA Document Solutions Inc., Osaka (JP)

(72) Inventor: Hirofumi Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/645,025

(22) Filed: Dec. 17, 2021

(65) Prior Publication Data

US 2022/0197188 A1 Jun. 23, 2022

(30) Foreign Application Priority Data

Dec. 21, 2020 (JP) ..... JP2020-211464

(51) Int. Cl.
*G03G 15/08* (2006.01)
*G03G 21/10* (2006.01)

(52) U.S. Cl.
CPC ..... *G03G 15/0891* (2013.01); *G03G 21/105* (2013.01); *G03G 15/0893* (2013.01);
(Continued)

(58) Field of Classification Search
CPC ..... G03G 15/0891; G03G 21/105; G03G 15/0893; G03G 2215/0827;
(Continued)

(56) References Cited

U.S. PATENT DOCUMENTS

2003/0234262 A1* 12/2003 Hart ..... G03G 21/105 222/233
2010/0028051 A1* 2/2010 Takemoto ..... G03G 15/0808 399/254

FOREIGN PATENT DOCUMENTS

JP 2000181315 A * 6/2000
JP 2007147773 A * 6/2007
JP 2010128437 A 6/2010

* cited by examiner

*Primary Examiner* — Arlene Heredia
*Assistant Examiner* — Laura Roth
(74) *Attorney, Agent, or Firm* — Alleman Hall Creasman & Tuttle LLP

(57) ABSTRACT

A toner conveying device includes a case that can store therein toner to be conveyed, a conveyance member rotatably supported at both ends thereof by the case and configured to rotate to convey the toner inside the case in a conveying direction set in advance, and a pushing member pushed against the conveyance member and configured to slide on an outer peripheral portion of the conveyance member as the conveyance member rotates. The pushing member includes a first sheet member having flexibility and abutting on the outer peripheral portion in a first direction intersecting with a rotational axis direction of the conveyance member to push the conveyance member and a second sheet member having flexibility and abutting on the outer peripheral portion in a second direction, which is different from the first direction, intersecting with the rotational axis direction to push the conveyance member.

6 Claims, 13 Drawing Sheets

(52) U.S. Cl.
CPC ..... *G03G 2215/0838* (2013.01); *G03G 2221/1624* (2013.01)

(58) Field of Classification Search
CPC ... G03G 2215/0838; G03G 2215/0841; G03G 2221/1624
See application file for complete search history.

TONER CONVEYING DEVICE OF IMAGE FORMING APPARATUS INCLUDING PUSHING MEMBER TO PUSH CONVEYANCE MEMBER FROM DIFFERENT DIRECTIONS

INCORPORATION BY REFERENCE

This application is based upon and claims the benefit of priority from the corresponding Japanese Patent Application No. 2020-211464 filed on Dec. 21, 2020, the entire contents of which are incorporated herein by reference.

The present disclosure relates to a toner conveying device, a cleaning device, and an image forming apparatus.

BACKGROUND

An image forming apparatus that forms images using developer such as toner includes a cleaning device. The cleaning device removes toner remaining on an image-carrying member (waste toner) from the image-carrying member after transfer. The image forming apparatus further includes a waste toner storage case for storing the waste toner. The waste toner removed by the cleaning device is conveyed by a conveyance member provided for the housing of the cleaning device and is stored inside the waste toner storage case.

The image forming apparatus further includes a developing device that forms toner images on the image-carrying member. The developing device stores therein developer including the toner. As the toner inside the developing device decreases with development, a toner supply device supplies the toner from a toner case to the developing device. The toner supply device includes a conveyance member that can convey the toner. The conveyance member conveys the toner from the toner case to the developing device.

SUMMARY

A toner conveying device according to an aspect of the present disclosure includes a case that can store therein toner to be conveyed, a conveyance member rotatably supported at both ends thereof by the case and configured to rotate to convey the toner inside the case in a conveying direction set in advance, and a pushing member pushed against the conveyance member and configured to slide on an outer peripheral portion of the conveyance member as the conveyance member rotates. The pushing member includes a first sheet member having flexibility and abutting on the outer peripheral portion in a first direction intersecting with a rotational axis direction of the conveyance member to push the conveyance member and a second sheet member having flexibility and abutting on the outer peripheral portion in a second direction, which is different from the first direction, intersecting with the rotational axis direction to push the conveyance member.

A cleaning device according to another aspect of the present disclosure includes the toner conveying device and a removing member configured to remove remaining toner remaining on an image-carrying member after transfer. The toner conveying device is configured to convey the remaining toner removed by the removing member.

An image forming apparatus according to yet another aspect of the present disclosure includes the toner conveying device, a developing portion configured to develop a toner image on an image-carrying member, and a transfer portion configured to transfer the toner image from the image-carrying member to a transfer member. The toner conveying device is configured to convey toner from a toner storing portion that stores the toner to the developing portion.

According to the present disclosure, even when the conveyance member is brought into contact with other members and subjected to load by the other members, the conveyance member is prevented from warping and can be supported stably.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings as appropriate. It should be noted that the following embodiments are only examples of specific embodiments of the present disclosure and should not limit the technical scope of the present disclosure. For purposes of illustration, the vertical direction in a state where the image forming apparatus 10 is installed and ready for use (state shown in FIG. 1) is defined as an up-down direction D1. In addition, a front-rear direction D2 is defined based on the premise that the face on the left of the page in FIG. 1 serves as the front (front face). In addition, a left-right direction D3 is defined relative to the front of an image forming apparatus 10 in the installed state.

First Embodiment

Figure 1:
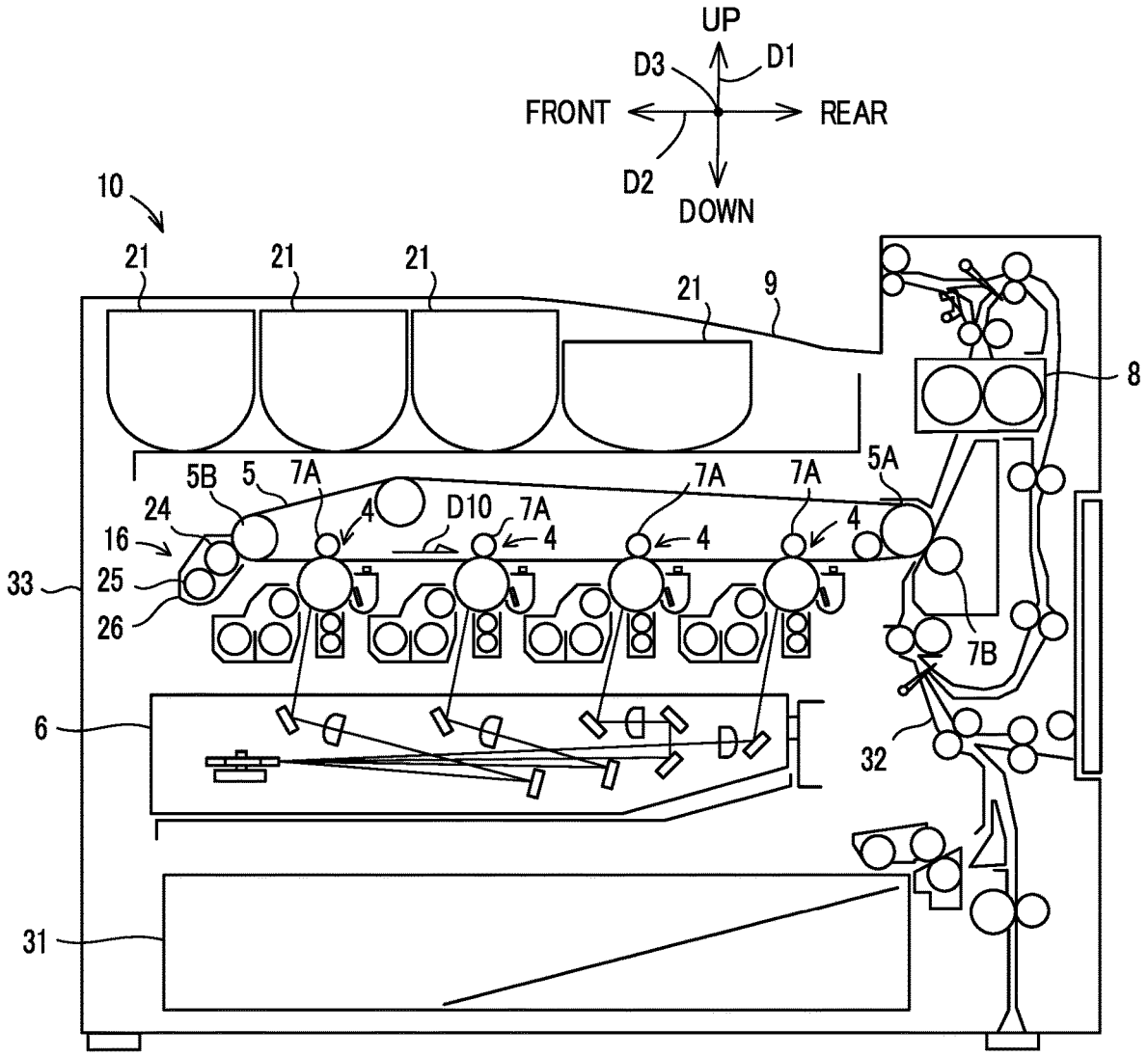
FIG. 1 shows the configuration of an image forming apparatus according to a first embodiment of the present disclosure.

As shown in FIG. 1, the image forming apparatus 10 includes four image forming units 4, an intermediate transfer belt 5, a laser scanning unit 6, four primary transfer rollers 7A, a secondary transfer roller 7B, a fixing device 8, a sheet discharge tray 9, four toner containers 21 (an example of a toner storing portion of the present disclosure), a sheet feed cassette 31, a sheet conveyance path 32, a belt cleaning device 16, and a case 33 that houses the above. The image forming apparatus 10 is a printer that forms color or monochrome images based on image data input from information processing apparatuses such as personal computers on sheets supplied from the sheet feed cassette 31 along the sheet conveyance path 32. In addition, facsimiles, copiers, multifunction peripherals, and the like are also examples of the image forming apparatus according to the present disclosure.

The image forming units 4 are aligned in a traveling direction D10 of the intermediate transfer belt 5 to constitute an image forming portion of a so-called tandem type. The image forming units 4 form toner images on the surfaces of respective photoconductor drums 11 (see FIGS. 2 and 3) by an electrophotographic method and transfer the toner images onto the intermediate transfer belt 5. The image forming units 4 form toner images of corresponding colors.

Figure 3:
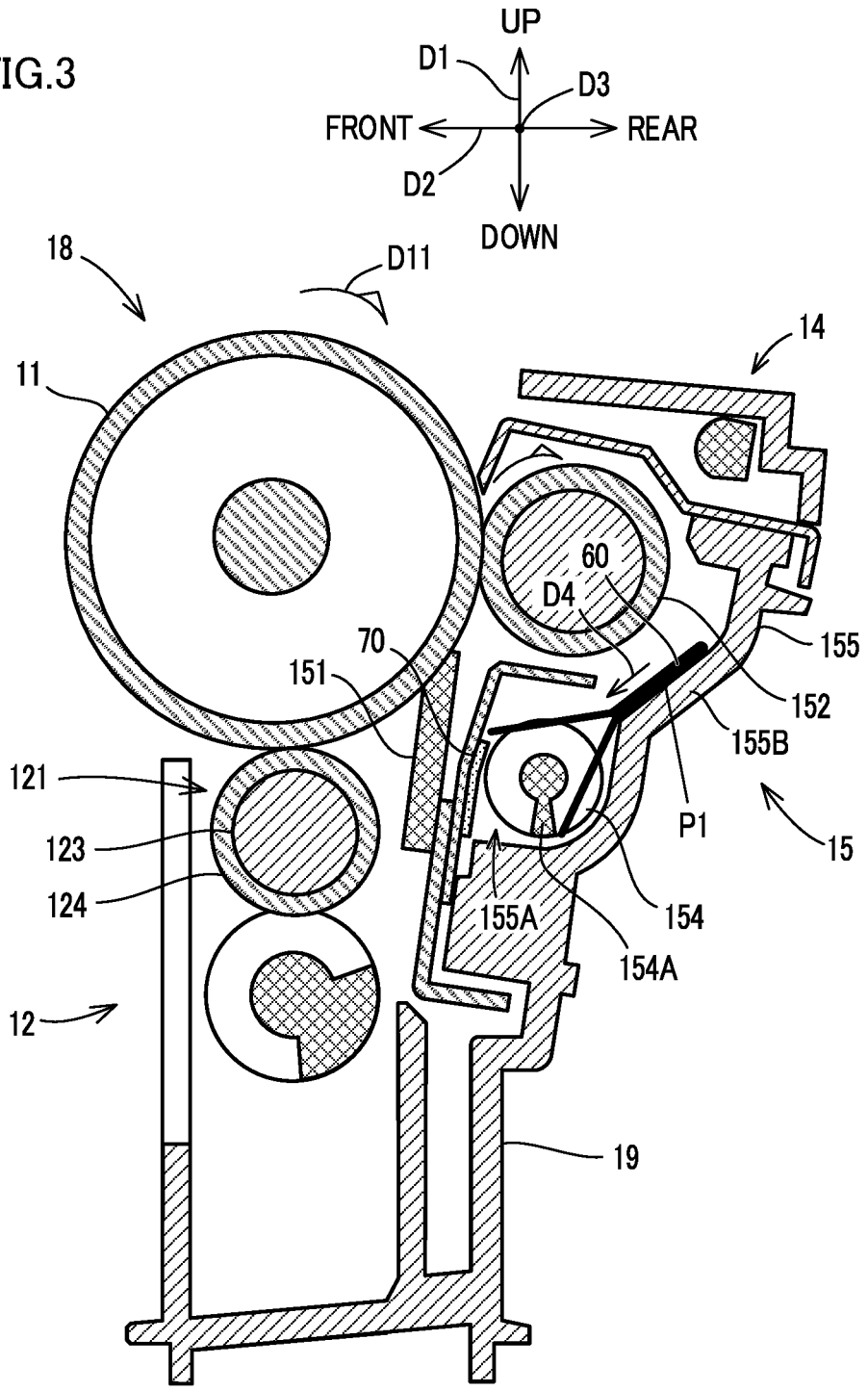
FIG. 3 is a cross-sectional view of the configuration of the drum unit.
Figure 4:
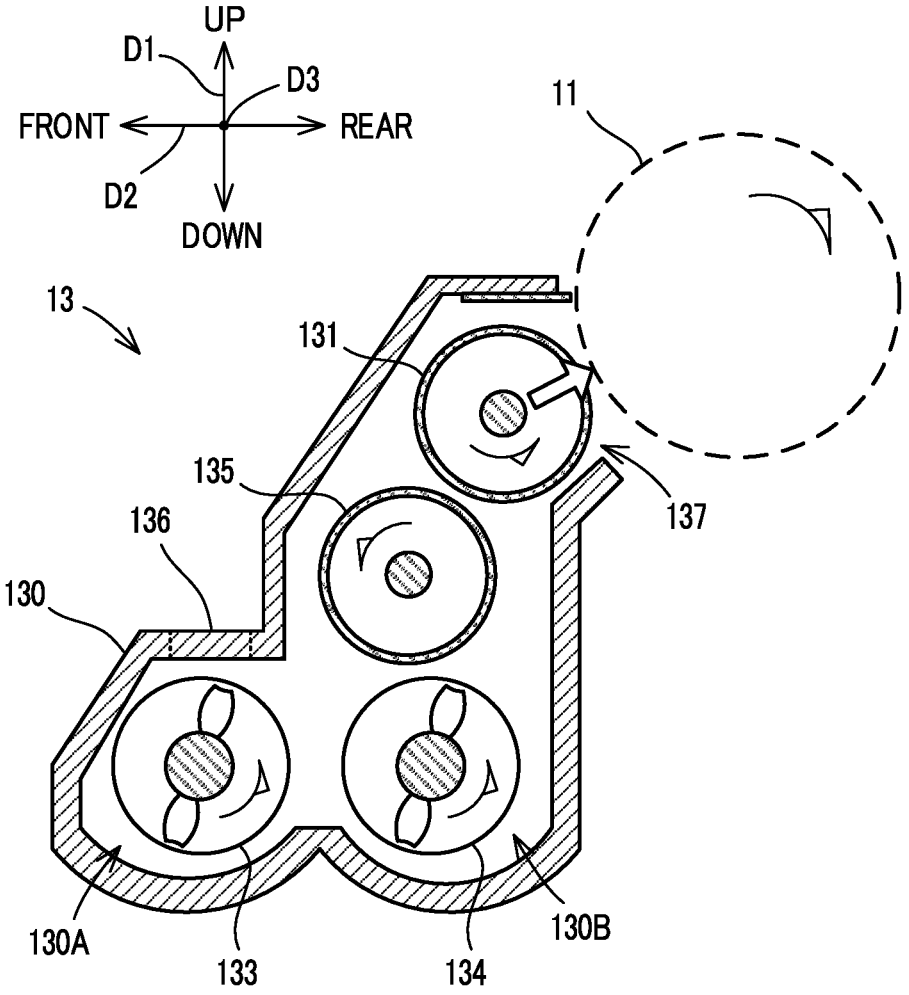
FIG. 4 is a cross-sectional view of the configuration of a developing device included in the image forming apparatus.

Each of the image forming units 4 includes a drum unit 18 (see FIGS. 2 and 3) and a developing device 13 (see FIG. 4). The developing device 13 is an example of a developing portion of the present disclosure.

Figure 2:
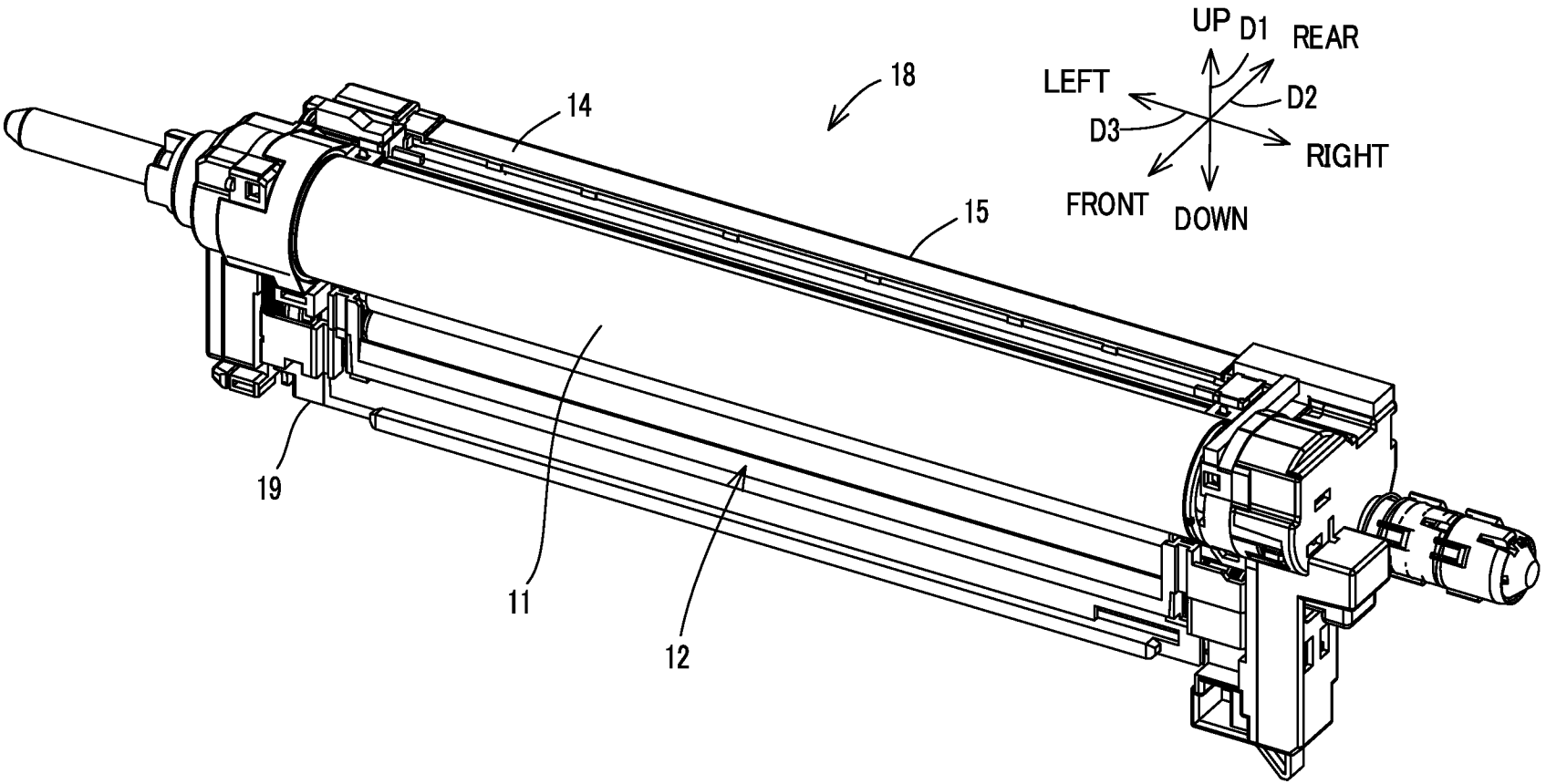
FIG. 2 is a perspective view of a drum unit included in the image forming apparatus.

FIG. 2 is a perspective view of the drum unit 18. FIG. 3 is a cross-sectional view schematically showing the internal configuration of the drum unit 18.

As shown in FIG. 3, the drum unit 18 includes the photoconductor drum 11, a charging device 12, a static eliminating portion 14, a drum cleaning device 15 (an example of a cleaning device of the present disclosure), and a housing 19 that houses the above. The drum unit 18 has a body elongated in one direction. In FIG. 1, the drum unit 18 is disposed inside the case 33 such that the longitudinal direction of the drum unit 18 corresponds to the left-right direction D3 of the image forming apparatus 10. In the description below, the up-down direction D1, the front-rear direction D2, and the left-right direction D3 of the drum unit 18 are defined relative to the state where the drum unit 18 is installed inside the case 33.

The photoconductor drum 11 is an image-carrying member that carries electrostatic latent images and toner images. The photoconductor drum 11 is disposed to face a developing roller 131 (see FIG. 4) of the developing device 13 with a predetermined development gap therebetween. The photoconductor drum 11 is configured to be able to carry toner images, formed from toner supplied by the developing roller 131 at the development gap, on the outer peripheral surface of the photoconductor drum 11. The photoconductor drum 11 is a tubular member with a cylindrical shape and includes a photosensitive layer on the outer peripheral surface thereof. The photoconductor drum 11 is rotatably supported by the housing 19. The photoconductor drum 11 receives a rotational driving force transmitted from a motor (an example of a driving source). As the motor is driven by a control portion, the rotational driving force is transmitted to the photoconductor drum 11 and causes the photoconductor drum 11 to be rotationally driven in a predetermined direction. The predetermined direction is, for example, a rotation direction opposite the rotation direction of the developing roller 131.

As shown in FIG. 3, the charging device 12 is disposed under the photoconductor drum 11 and is located in a lower portion of the housing 19. The charging device 12 charges the photosensitive layer on the outer peripheral surface of the photoconductor drum 11 to a prescribed potential set in advance. To charge the photoconductor drum 11 to the prescribed potential, the charging device 12 applies a uniform and even bias voltage to the outer peripheral surface of the photoconductor drum 11 by, for example, corona discharge. The bias voltage is higher than the prescribed potential.

The charging device 12 includes a charging roller 121 that charges the photoconductor drum 11 using an electric power supplied from a power source (not shown). The charging roller 121 is a circular cylindrical member including a conductive metal shaft (conductive shaft) 123 and an elastic layer 124 disposed on the surface of the metal shaft 123. The elastic layer 124 is formed from, for example, conductive foam rubber or non-foam rubber; specifically, formed from epichlorohydrin rubber or polyurethane rubber into which conductive filler such as titanium oxide is dispersedly mixed as a conductive agent. The charging roller 121 is pressed against the photoconductor drum 11 by a biasing member (not shown) such as a spring at a predetermined load to form a nip portion between the charging roller 121 and the photoconductor drum 11.

The photoconductor drum 11 charged by the charging device 12 is exposed to a laser beam emitted by the laser scanning unit 6. This forms electrostatic latent images based on image data on the outer peripheral surface of the photoconductor drum 11.

FIG. 4 is a cross-sectional view schematically showing the internal configuration of the developing device 13.

The developing device 13 develops the electrostatic latent images using toner by a development method that causes the toner to electrostatically adhere to the photoconductor drum 11 while the developing device 13 is not in contact with the photoconductor drum 11. As shown in FIG. 4, the developing device 13 includes a developing case 130, a first stirring screw 133, a second stirring screw 134, a magnetic roller 135, and the developing roller 131. The developing case 130 stores developer including the toner in a bottom portion thereof. As the first stirring screw 133 and the second stirring screw 134 (an example of a conveyance member) rotate, the developer in the bottom portion of the developing case 130 is stirred and conveyed in a predetermined direction.

The magnetic roller 135 draws up the developer from the second stirring screw 134 using an embedded magnetic pole and causes only the toner included in the developer to adhere to the surface of the developing roller 131. The developing roller 131 is disposed away from the outer peripheral surface of the photoconductor drum 11 by a predetermined distance. The toner held on the developing roller 131 adheres to the electrostatic latent images on the photoconductor drum 11 due to the potential difference applied between the developing roller 131 and the photoconductor drum 11.

The developing case 130 stores the developer in the bottom portion thereof. The two stirring screws 133, 134 are rotatably disposed in the bottom portion of the developing case 130. The stirring screws 133, 134 are spiral shafts each including a shaft member and a spiral blade spirally formed on the shaft member. The bottom portion of the developing case 130 is partitioned into two toner conveyance paths 130A, 130B divided in the front-rear direction D2. The first stirring screw 133 is rotatably disposed in the toner conveyance path 130A adjacent to the front, and the second stirring screw 134 is rotatably disposed in the toner conveyance path 130B adjacent to the rear. The rotation of the stirring screws 133, 134 causes the developer to be stirred. This causes the toner to carry predetermined electrical charges and causes the carrier to be charged with polarity opposite the polarity of the toner.

The developing case 130 has a toner supply port 136 in the outer wall thereof. A toner supply device supplies unused toner into the developing case 130 from the corresponding toner container 21 that stores the unused toner through the toner supply port 136.

The developing roller 131 is rotatably disposed inside the developing case 130. The developing roller 131 is disposed above the second stirring screw 134. The developing roller 131 constitutes a magnet roller together with an embedded magnet. The developing roller 131 serves as a magnetic brush that holds the developer on the surface thereof by the effect of magnetic force of the embedded magnet.

The developing roller 131 is disposed to face the outer peripheral surface of the photoconductor drum 11 at an opening 137 (on the right side in FIG. 4) of the developing case 130. A developing bias of a predetermined voltage is applied to the developing roller 131. The difference in voltage caused by the developing bias creates the spike-like magnetic brush at the development gap, and the toner in the magnetic brush adheres to the electrostatic latent images on the photoconductor drum 11. This causes the electrostatic latent images on the photoconductor drum 11 to be developed by the toner. In other words, toner images are formed on the photoconductor drum 11.

The primary transfer rollers 7A are an example of a transfer portion of the present disclosure and transfer the toner images formed on the respective photoconductor drums 11 to the intermediate transfer belt 5. Each of the primary transfer rollers 7A is disposed over the corresponding photoconductor drum 11 to face the photoconductor drum 11 such that the intermediate transfer belt 5 is held between the primary transfer roller 7A and the photoconductor drum 11.

The intermediate transfer belt 5 is an intermediate transfer member (an example of a transfer member) that travels over the photoconductor drums 11 of the image forming units 4 and onto which the toner images of colors formed on the respective photoconductor drums 11 are sequentially transferred and superposed. The intermediate transfer belt 5 is stretched by support rollers such as a drive roller 5A and a driven roller 5B and conveys the toner images transferred to the surface of the intermediate transfer belt 5 to the secondary transfer roller 7B as the drive roller 5A is rotationally driven.

The toner images on the intermediate transfer belt 5 are transferred by the secondary transfer roller 7B to sheets conveyed along the sheet conveyance path 32. The secondary transfer roller 7B is an example of the transfer portion of the present disclosure and transfers the toner images on the intermediate transfer belt 5 to sheets (an example of the transfer member) such as printing sheets. The secondary transfer roller 7B is disposed to face the drive roller 5A such that the intermediate transfer belt 5 is held between the secondary transfer roller 7B and the drive roller 5A. The toner images transferred to the sheets are heated and fixed onto the sheets by the fixing device 8.

As shown in FIG. 3, the static eliminating portion 14 emits static eliminating light for eliminating static charge from the photoconductor drum 11 to an area on the outer peripheral surface of the photoconductor drum 11 between the corresponding primary transfer roller 7A and the drum cleaning device 15. In other words, the static eliminating portion 14 emits the static eliminating light to an area on the surface of the photoconductor drum 11 downstream of the corresponding primary transfer roller 7A and upstream of the drum cleaning device 15 in a rotation direction D11. This eliminates static charge from the surface of the photoconductor drum 11. Eliminating static charge from the surface of the photoconductor drum 11 prevents so-called residual images on the photoconductor drum 11.

The drum cleaning device 15 removes the toner remaining on the photoconductor drum 11. As shown in FIG. 3, the drum cleaning device 15 is disposed behind the photoconductor drum 11. The drum cleaning device 15 is provided for the corresponding photoconductor drum 11. The drum cleaning device 15 includes a cleaning blade 151 (an example of a removing member of the present disclosure) serving as a cleaning member, a cleaning roller 152 (an example of the removing member of the present disclosure), a conveyance member 154, a pushing member 60, and a storing portion 155 that houses the above. It is noted that the conveyance member 154, the pushing member 60, and the storing portion 155 concretely achieve a toner conveying device of the present disclosure.

The storing portion 155 is an example of a case of the present disclosure and is integral to the housing 19. The storing portion 155 is the case of the drum cleaning device 15. The storing portion 155 supports the cleaning blade 151 and the cleaning roller 152. The cleaning blade 151 and the cleaning roller 152 have lengths approximately equal to that of the photoconductor drum 11. An end of the cleaning blade 151 is disposed to be in contact with or close to the surface of the photoconductor drum 11.

The cleaning roller 152 is supported to be rotatable inside the storing portion 155. The cleaning roller 152 rotates as a rotational driving force is input to a support shaft of the cleaning roller 152. The cleaning roller 152 rotates while being in contact with the surface of the photoconductor drum 11 and thereby removes the toner remaining on the surface of the photoconductor drum 11 after the transfer by the corresponding primary transfer roller 7A. The removed toner is supposed to be discarded and will be referred to as "waste toner" below. The waste toner is an object to be conveyed by the conveyance member 154. The waste toner moves to a bottom portion of the storing portion 155 due to the effect of gravity or the rotational force of the cleaning roller 152. In addition, as the photoconductor drum 11 rotates, the cleaning blade 151 removes the waste toner that has not been removed by the cleaning roller 152. The waste toner removed by the cleaning blade 151 also moves to the bottom portion of the storing portion 155.

The storing portion 155 has a toner conveyance path 155A formed in the interior thereof. More specifically, the toner conveyance path 155A extending in the left-right direction D3 is formed in the bottom portion of the storing portion 155. The toner conveyance path 155A extends in the left-right direction D3 in the bottom portion of the storing portion 155. The waste toner is stored in the toner conveyance path 155A. The conveyance member 154 is disposed in the toner conveyance path 155A. The waste toner stored in the toner conveyance path 155A is conveyed by the conveyance member 154 in a predetermined direction. In the present embodiment, the toner conveyance path 155A is formed in the bottom portion of the storing portion 155. However, the configuration is given for illustration and is not intended to limit the present disclosure. For example, the present disclosure is applicable not only to the configuration that includes the concrete toner conveyance path 155A formed in the bottom portion of the storing portion 155 but to any configuration that stores toner, serving as an object to be conveyed by the conveyance member 154, inside the storing portion 155.

The conveyance member 154 extends in the left-right direction D3 along the toner conveyance path 155A. The conveyance member 154 is a so-called spiral shaft including a shaft member 154B extending in the left-right direction D3 along the toner conveyance path 155A and a spiral blade 154A (an example of a spiral blade of the present disclosure) spirally formed on the shaft member 154B. The conveyance member 154 is provided with support shafts 156 (see FIGS. 7A and 7B) at both axial ends thereof. The support shafts 156 are rotatably supported by the left and right walls of the storing portion 155. The conveyance member 154 receives a rotational driving force transmitted from a motor. As the motor is driven by a control portion, the rotational driving force is transmitted to the conveyance member 154 and causes the conveyance member 154 to be rotationally driven in a predetermined direction. The rotation of the conveyance member 154 causes the waste toner in the toner conveyance path 155A to be conveyed downstream in the conveying direction in the toner conveyance path 155A.

It is noted that the conveyance member 154 is supported only by the sidewalls. That is, a portion of the conveyance member 154 between one of the support shafts 156 and the other support shaft 156 is supported so as to float above the bottom portion of the storing portion 155 (that is, the bottom portion of the toner conveyance path 155A) without touching either the front wall surface or the rear wall surface.

A discharge port (not shown) communicating with the toner conveyance path 155A is formed in the right wall of the storing portion 155. The waste toner is discharged from the discharge port to the outside when the waste toner is conveyed by the conveyance member 154 to the right. The discharged waste toner is collected in a waste toner bottle (not shown).

As shown in FIG. 3, the drum cleaning device 15 includes the pushing member 60 disposed inside the storing portion 155. The pushing member 60 is a member for scraping off toner adhering to the conveyance member 154 provided for the drum cleaning device 15. The pushing member 60 is attached to the inner wall of the storing portion 155 and protrudes from an attachment position P1 (securing position) in a direction D4 toward the conveyance member 154. The pushing member 60 abuts on the outer peripheral portion of the conveyance member 154 and pushes the conveyance member 154. When the conveyance member 154 rotates in this state, the pushing member 60 slides on the outer peripheral portion of the conveyance member 154. The configuration of the pushing member 60 will be described later.

In the present embodiment, the drum unit 18 is unitized by installing the photoconductor drum 11, the charging device 12, and the drum cleaning device 15 in the housing 19. However, the configuration is given for illustration and is not intended to limit the present disclosure. The drum cleaning device 15 may be configured as a device separate from the drum unit 18.

As shown in FIG. 1, the belt cleaning device 16 is disposed in front of the intermediate transfer belt 5. The belt cleaning device 16 includes a cleaning roller 24 (an example of the removing member of the present disclosure) serving as a cleaning member, a conveyance member 25 including a shaft member and a blade (an example of the spiral blade) spirally formed on the shaft member, and a housing 26 that houses the above. The cleaning roller 24 is disposed to face the driven roller 5B that supports the intermediate transfer belt 5, and the surface of the cleaning roller 24 is in contact with the intermediate transfer belt 5. The cleaning roller 24 has a length approximately equal to the width of the intermediate transfer belt 5.

The cleaning roller 24 is supported to be rotatable inside the housing 26. The cleaning roller 24 rotates as a rotational driving force is input to a support shaft of the cleaning roller 24. The cleaning roller 24 rotates while being in contact with the surface of the intermediate transfer belt 5 and thereby removes the toner remaining on the surface of the intermediate transfer belt 5 (remaining toner) after the transfer by the secondary transfer roller 7B. The removed toner is supposed to be discarded and will be referred to as "waste toner" below. The waste toner is an object to be conveyed by the conveyance member 25. The waste toner moves to a bottom portion of the housing 26 due to the effect of gravity or the rotational force of the cleaning roller 24. A toner conveyance path (not shown) is defined in the bottom portion of the housing 26, and the conveyance member 25 is disposed in the toner conveyance path. The waste toner stored in the toner conveyance path is conveyed by the conveyance member 25 in a predetermined direction.

A discharge port (not shown) communicating with the toner conveyance path defined in the bottom portion of the housing 26 is formed in the right wall of the housing 26. The waste toner is discharged from the discharge port to the outside when the waste toner is conveyed by the conveyance member 25 to the right. The discharged waste toner is collected in the waste toner bottle (not shown).

The configuration of the pushing member 60 included in the drum cleaning device 15 will now be described.

Figure 5:
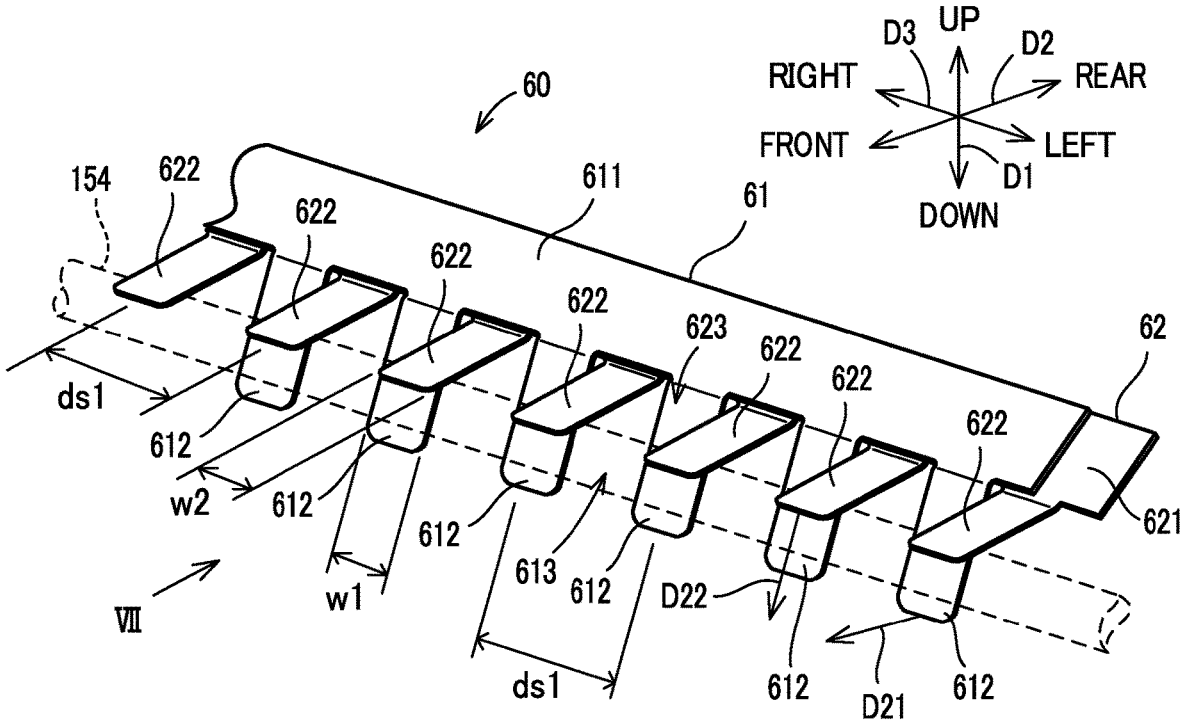
FIG. 5 is a perspective view of an example pushing member included in the drum unit.

As shown in FIG. 3, the pushing member 60 is disposed behind and obliquely above the conveyance member 154 inside the storing portion 155 of the drum cleaning device 15. As shown in FIG. 5, the pushing member 60 includes an upper sheet portion 61 (an example of a first sheet member of the present disclosure) disposed at a higher position and a lower sheet portion 62 (an example of a second sheet member of the present disclosure) disposed at a lower position. Here, FIG. 5 is a perspective view of the pushing member 60. In FIG. 5, the conveyance member 154 is indicated by broken lines.

The upper sheet portion 61 and the lower sheet portion 62 are composed of thin, film-like sheet members formed from a flexible elastic material such as PET (polyethylene terephthalate) resin. It is noted that the upper sheet portion 61 and the lower sheet portion 62 are not necessarily formed from PET resin and may be formed from synthetic resin such as vinyl chloride or polycarbonate.

The upper sheet portion 61 abuts on the outer peripheral portion (lower back portion) of the conveyance member 154 in a first direction D21 (see FIGS. 5, 8A, and 8B) pointing obliquely forward and upward from the lower back relative to the shaft member 154B of the conveyance member 154 and pushes the conveyance member 154 in the first direction D21. The upper sheet portion 61 is a film member elongated in the left-right direction D3 and having a length approximately equal to the axial length of the conveyance member 154. The upper sheet portion 61 includes a base portion 611 secured at the attachment position P1 (see FIG. 3) defined on the inner surface of the rear wall 155B (see FIG. 3) of the storing portion 155 and a plurality of protruding pieces 612 protruding from the base portion 611 toward the conveyance member 154.

Figure 8A:
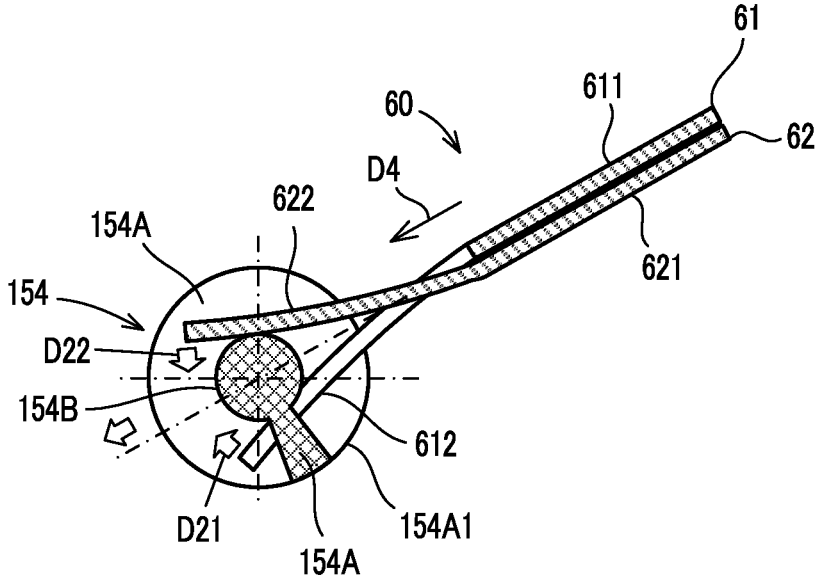
FIG. 8A is a cross-sectional view taken along cutting plane VIIIA-VIIIA in FIG. 7A and showing the configurations of the conveyance member and the pushing member in cross-section.
Figure 8B:
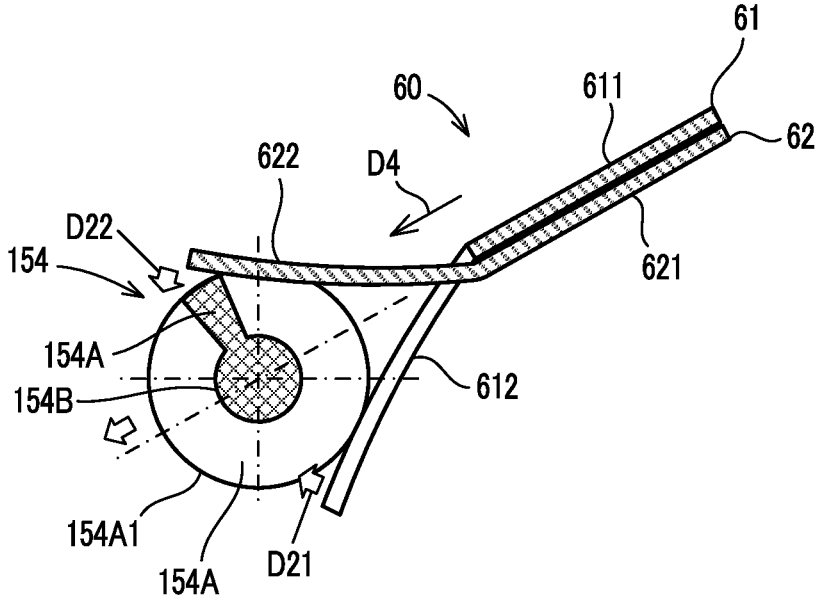
FIG. 8B is a cross-sectional view taken along cutting plane VIIIB-VIIIB in FIG. 7B and showing the configurations of the conveyance member and the pushing member in cross-section.

The length of the protruding pieces 612 is set sufficiently long for the protruding pieces 612 to abut on the outer peripheral portion of the conveyance member 154. Specifically, as shown in FIGS. 8A and 8B, the length of the protruding pieces 612 is set sufficiently long for the distal ends of the protruding pieces 612 to pass the center of the conveyance member 154. More preferably, the length of the protruding pieces 612 is set sufficiently short for the distal ends of the protruding pieces 612 not to pass the opposite end of the spiral blade 154A of the conveyance member 154 in directions along which the protruding pieces 612 protrude. In addition, the protruding pieces 612 are aligned at regular intervals in the axial direction of the conveyance member 154. In the present embodiment, the alignment interval between the protruding pieces 612 is set equal to the pitch (=ds1) of the spiral blade 154A of the conveyance member 154. For example, the alignment interval between the protruding pieces 612 and the pitch of the spiral blade 154A are both set to 14 mm.

In addition, the width w1 of the protruding pieces 612 is set less than the separation distance (=ds2) between two adjacent flights of the spiral blade 154A separated in the axial direction of the conveyance member 154. In the present embodiment, the width w1 is set to half the separation distance. Here, the separation distance is a length obtained by subtracting the thickness of the spiral blade 154A from the pitch (=ds1) of the spiral blade 154A on the conveyance member 154.

In addition, the lower sheet portion 62 abuts on the outer peripheral portion (upper front area) of the conveyance member 154 in a second direction D22 (see FIGS. 5, 8A, and 8B) pointing obliquely backward and downward from the upper front relative to the shaft member 154B of the conveyance member 154 and pushes the conveyance member 154 in the second direction D22. The lower sheet portion 62 is a film member elongated in the left-right direction D3 and having a length approximately equal to the axial length of the conveyance member 154. The lower sheet portion 62 includes a base portion 621 secured at the attachment position P1 (see FIG. 3) defined on the inner surface of the rear wall 155B (see FIG. 3) of the storing portion 155 and a plurality of protruding pieces 622 protruding from the base portion 621 toward the conveyance member 154.

The length of the protruding pieces 622 is set sufficiently long for the protruding pieces 622 to abut on the outer peripheral portion of the conveyance member 154. Specifically, as shown in FIGS. 8A and 8B, the length of the protruding pieces 622 is set equal to that of the protruding pieces 612 and is set sufficiently long for the distal ends of the protruding pieces 622 to pass the center of the conveyance member 154. More preferably, the length of the protruding pieces 622 is set sufficiently short for the distal ends of the protruding pieces 622 not to pass the opposite end of the spiral blade 154A of the conveyance member 154 in directions along which the protruding pieces 622 protrude. In addition, the protruding pieces 622 are aligned at regular intervals in the axial direction of the conveyance member 154. In the present embodiment, the alignment interval between the protruding pieces 622 is set equal to that of the protruding pieces 612, that is, equal to the pitch (=ds1) of the spiral blade 154A of the conveyance member 154.

In addition, the width w2 of the protruding pieces 622 is equal to the width w1 of the protruding pieces 612 and, more specifically, set less than the separation distance (=ds2) between two adjacent flights of the spiral blade 154A separated in the axial direction of the conveyance member 154. In the present embodiment, the width w2 is set to half the separation distance.

In addition, as shown in FIG. 5, the protruding pieces 612 of the upper sheet portion 61 and the protruding pieces 622 of the lower sheet portion 62 are shifted from each other in the axial direction of the conveyance member 154. Specifically, a protruding piece 612 and an adjacent protruding piece 622 are shifted from each other in the axial direction by half the pitch (=ds1) of the spiral blade 154A (=ds1/2).

Figure 6:
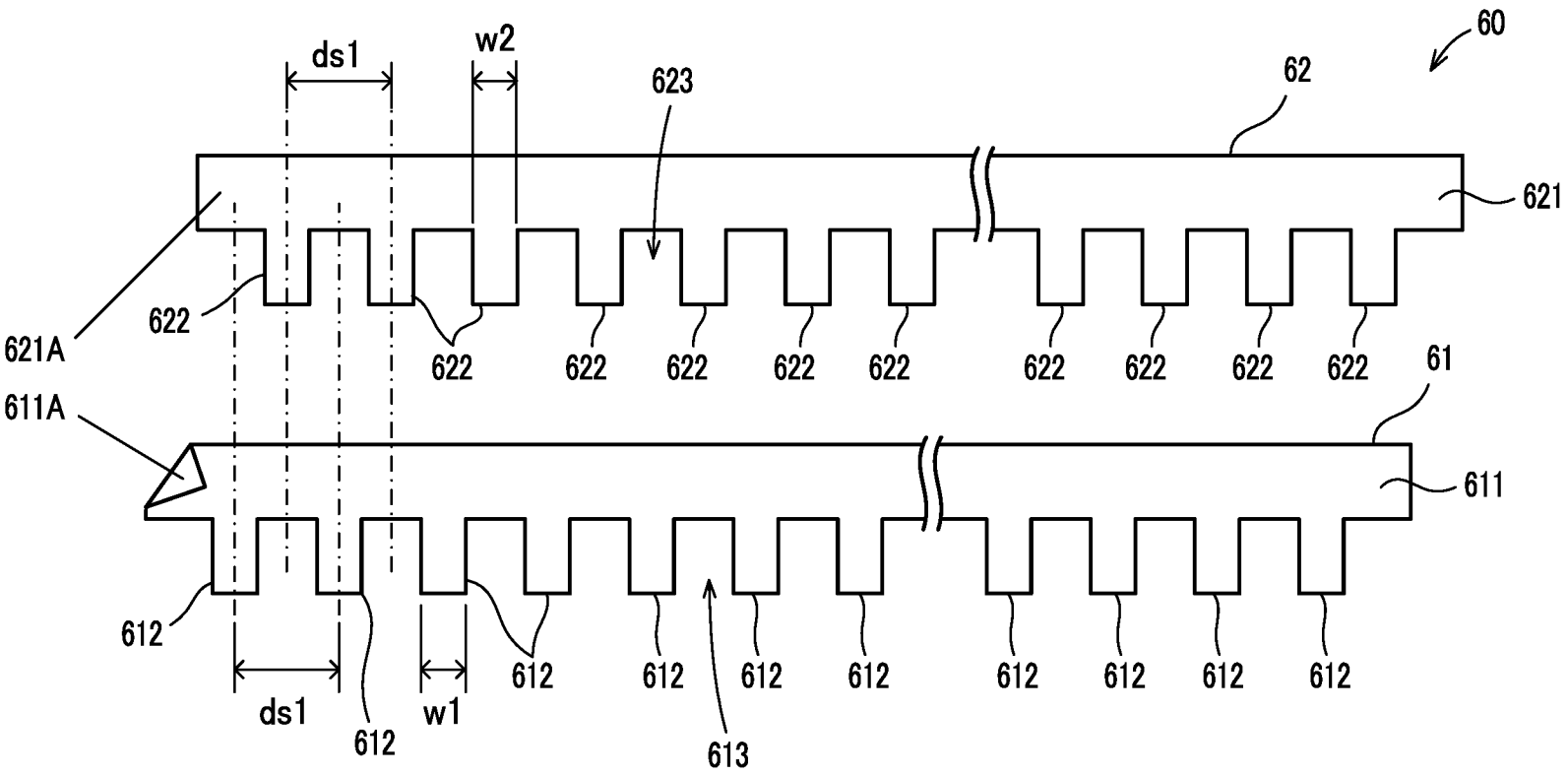
FIG. 6 is an exploded view of the pushing member.

In the present embodiment, as shown in FIG. 6, the pushing member 60 is produced by forming the upper sheet portion 61 and the lower sheet portion 62 into the identical shape and joining a joint surface 611A of the base portion 611 of the upper sheet portion 61 to a joint surface 621A of the base portion 621 of the lower sheet portion 62 while the sheet portions 61, 62 are shifted from each other in the longitudinal direction by half the pitch of the spiral blade 154A (=ds1/2). The base portion 611 and the base portion 621 may be joined by bonding means such as double-sided tape or by welding. In addition, the pushing member 60 may be secured at the attachment position P1 by bonding means such as double-sided tape or by fasteners such as screws.

The pushing force of the pushing member 60 against the conveyance member 154 by the protruding pieces 612, 622 can be achieved using the restoring force of the protruding pieces 612, 622 generated as the protruding pieces 612, 622 are warped. Specifically, the pushing force of the pushing member 60 is the restoring force (elastic force) generated as the protruding pieces 612 of the upper sheet portion 61 and the protruding pieces 622 of the lower sheet portion 62 are warped in directions away from each other.

In the present embodiment, the protruding pieces 612 are warped so as to enter rectangular gaps 623 between the protruding pieces 622 of the lower sheet portion 62. This causes the elastic force returning the protruding pieces 612 to the original positions to be generated in the protruding pieces 612, thereby causing the protruding pieces 612 to push the outer peripheral portion of the conveyance member 154 in the first direction D21 (see FIGS. 5, 8A, and 8B).

In addition, the protruding pieces 622 are warped so as to enter rectangular gaps 613 between the protruding pieces 612 of the upper sheet portion 61. This causes the elastic force returning the protruding pieces 622 to the original positions to be generated in the protruding pieces 622, thereby causing the protruding pieces 622 to push the outer peripheral portion of the conveyance member 154 in the second direction D22 (see FIGS. 5, 8A, and 8B).

Figure 7A:
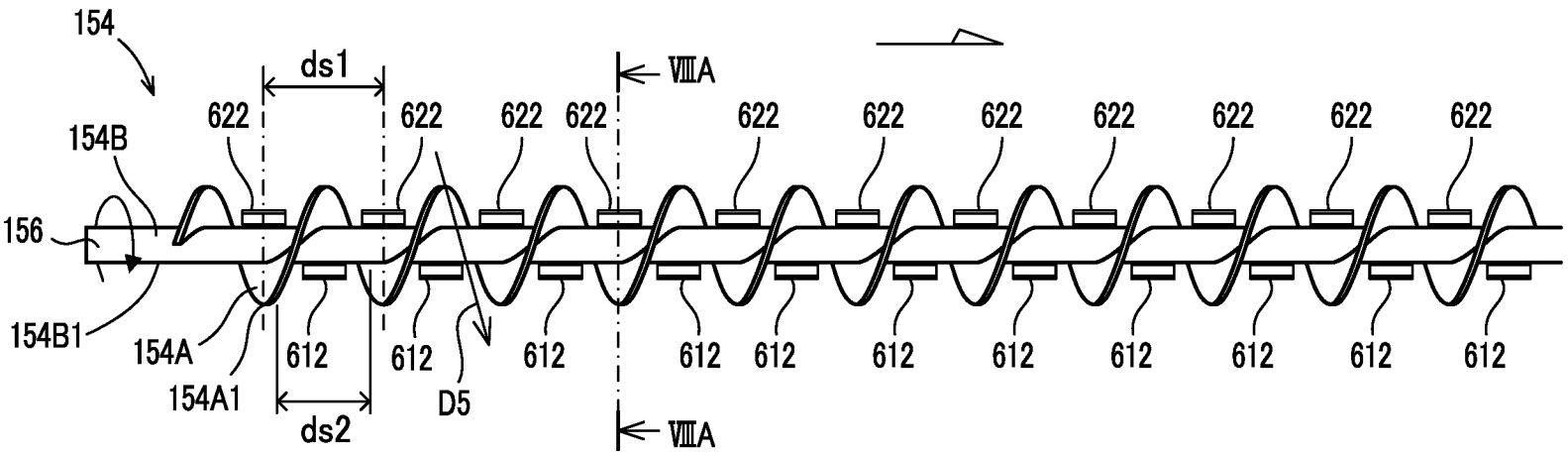
FIG. 7A shows the pushing member and a conveyance member that is in a first rotational position viewed in a direction of an arrow VII in FIG. 5.
Figure 7B:
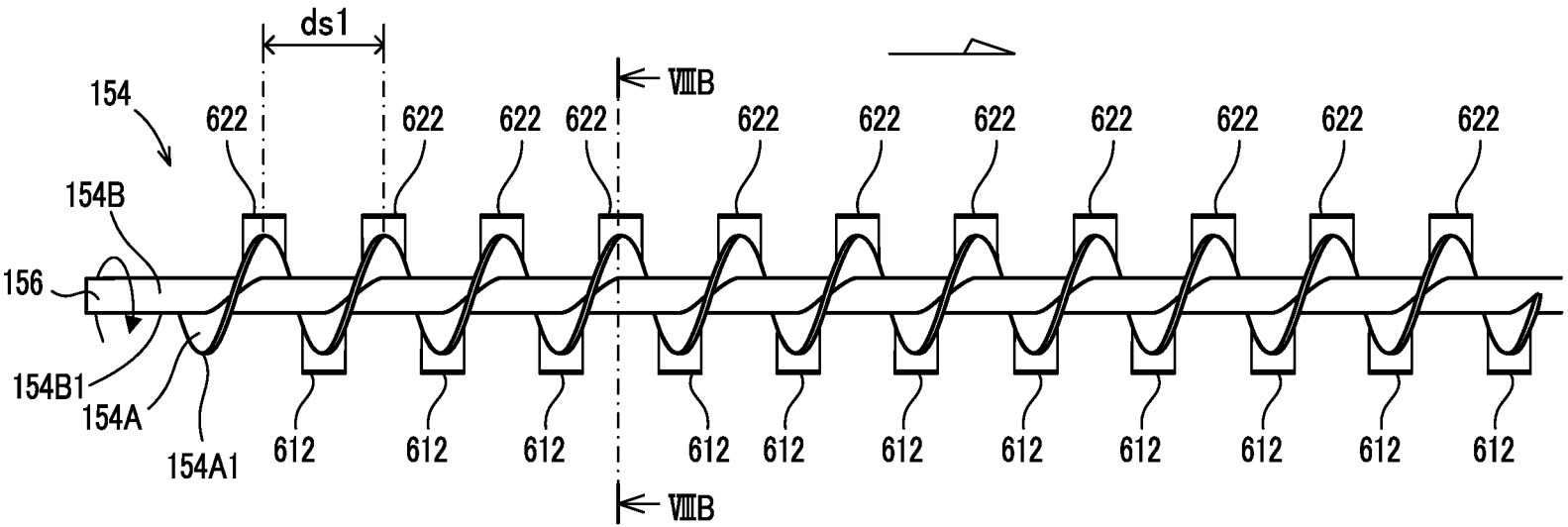
FIG. 7B shows the pushing member and the conveyance member that is in a second rotational position viewed in the direction of the arrow VII in FIG. 5.

FIGS. 7A and 7B show the pushing member 60 and the conveyance member 154 viewed in a direction of an arrow VII in FIG. 5. FIG. 7A shows the conveyance member 154 in a first rotational position, whereas FIG. 7B shows the conveyance member 154 in a second rotational position to which the conveyance member 154 rotates 180° from the first rotational position. In addition, FIGS. 8A and 8B are cross-sectional views of the configurations of the conveyance member 154 and the pushing member 60. FIG. 8A is a cross-sectional view taken cutting plane line VIIIA-VIIIA in FIG. 7A, whereas FIG. 8B is a cross-sectional view taken along cutting plane VIIIB-VIIIB in FIG. 7B.

There is known a stirring member that comes into contact with a rotating conveyance member and thereby stirs toner inside a toner conveyance path to prevent toner clogs.

However, the known stirring member abuts on the outer peripheral surface of the conveyance member in one direction (for example, from above downward), and the pushing force applied by the stirring member to the conveyance member in the one direction may warp the conveyance member. When the conveyance member is warped, the rotating shaft of the conveyance member cannot be supported stably. This leads to a reduction in the conveying efficiency of the conveyance member. In addition, the contact of the conveyance member with the inner wall of the housing of a cleaning device or an increase in the sliding resistance between the rotating shaft and bearings at both ends of the conveyance member may produce strange noises. According to the present embodiment, even when the conveyance member is brought into contact with other members and subjected to load by the other members, the conveyance member is prevented from warping and can be supported stably.

The pushing member 60 provided for the drum cleaning device 15 is configured as above. Accordingly, as shown in FIGS. 7A and 8A, when the conveyance member 154 is in the predetermined first rotational position (rotational position shown in FIG. 7A), all the protruding pieces 612, 622 are located in the gaps left at the pitch of the spiral blade 154A and abut on and push the outer peripheral surface 154B1 (an example of the outer peripheral portion of the conveyance member) of the shaft member 154B of the conveyance member 154. Specifically, the protruding pieces 612 abut on and push the outer peripheral surface 154B1 of the shaft member 154B in the first direction D21. In addition, the protruding pieces 622 abut on and push the outer peripheral surface 154B1 of the shaft member 154B in the second direction D22.

In addition, as shown in FIGS. 7B and 8B, when the conveyance member 154 is in the second rotational position (rotational position shown in FIG. 7B) to which the conveyance member 154 rotates 180° in the rotation direction from the first rotational position, all the protruding pieces 612, 622 abut on and push the outer peripheral edge 154A1 (an example of the outer peripheral portion of the conveyance member) of the spiral blade 154A. Specifically, the protruding pieces 612 abut on and push the outer peripheral edge 154A1 of the spiral blade 154A in the first direction D21. In addition, the protruding pieces 622 abut on and push the outer peripheral edge 154A1 of the spiral blade 154A in the second direction D22.

That is, the direction along which the conveyance member 154 is pushed by the pushing member 60 is not only one, but the conveyance member 154 is pushed by the protruding pieces 612, 622 in different directions. As a result, the pushing forces by the protruding pieces 612, 622 are balanced out. This reduces the load applied to the conveyance member 154 and thus prevents the conveyance member 154 from easily warping in directions intersecting with the axial direction. As a result, problems caused by the distortion of the conveyance member 154, for example, a reduction in the conveying efficiency caused by unstable support for the conveyance member 154, strange noises produced by the contact of the warped conveyance member 154 with the inner wall of the storing portion 155, and strange noises produced by an increase in the sliding resistance between the support shafts 156 and bearings at both ends of the conveyance member 154, can be solved. That is, even when the conveyance member 154 is brought into contact with the pushing member 60 and subjected to load, the conveyance member 154 is prevented from warping and can be supported stably.

It is noted that the first direction D21 and the second direction D22 are not opposite to each other and that the angle at which the directions D21, D22 intersect with each other corresponds to the angle formed between the protruding pieces 612 and the protruding pieces 622. Thus, as shown in FIGS. 8A and 8B, the conveyance member 154 is subjected to load applied by the pushing member 60 in a protruding direction D4 of the pushing member 60 at all times. This load may warp the conveyance member 154 in the protruding direction D4. To avoid this, in the present embodiment, a plate-like cushion member 70 is provided for the storing portion 155 as shown in FIG. 3. In FIG. 3, the cushion member 70 is attached to the inner wall of the storing portion 155 downstream of the conveyance member 154 in the protruding direction D4. The cushion member 70 may be provided in the entire area of the inner wall in the axial direction of the conveyance member 154. In addition, the cushion member 70 may be provided at a position corresponding to a portion of the conveyance member 154 to be warped the most when the conveyance member 154 is subjected to the load, that is, the middle part of the conveyance member 154.

The cushion member 70 is a thin film portion of about 0.3 mm in thickness and is composed of a resin member formed from a material with a low sliding resistance including, for example, polyacetal (POM). Even when the conveyance member 154 is warped in the protruding direction D4, the cushion member 70 configured as above can reduce the resistance caused by the contact. This prevents a reduction in the conveying efficiency of the conveyance member 154 and reduces strange noises caused by the contact.

In addition, in the present embodiment, the protruding pieces 612 are warped so as to enter the rectangular gaps 623 between the protruding pieces 622 of the lower sheet portion 62, whereas the protruding pieces 622 are warped so as to enter the rectangular gaps 613 between the protruding pieces 612 of the upper sheet portion 61 as described above. The conveyance member 154 is disposed in a portion surrounded by the protruding pieces 612, 622 warped in the above-described manner. Thus, even when the warped positions of the protruding pieces 612, 622 repeatedly change due to the rotation of the conveyance member 154, the base portion 611 and the base portion 621 joined together are not easily separated from each other.

Second Embodiment

Figure 9:
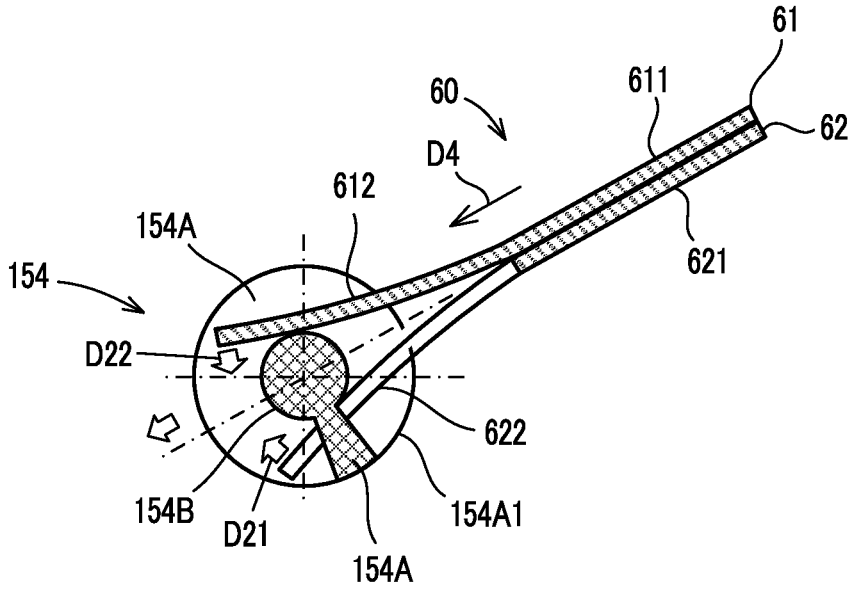
FIG. 9 is a cross-sectional view of a pushing member according to a second embodiment of the present disclosure.

As shown in FIG. 9, the pushing member 60 may include the protruding pieces 612 warped in a direction away from the lower sheet portion 62 and the protruding pieces 622 warped in a direction away from the upper sheet portion 61. The conveyance member 154 is disposed in a portion surrounded by the protruding pieces 612, 622 warped in the above-described manner.

Third Embodiment

Figure 10:
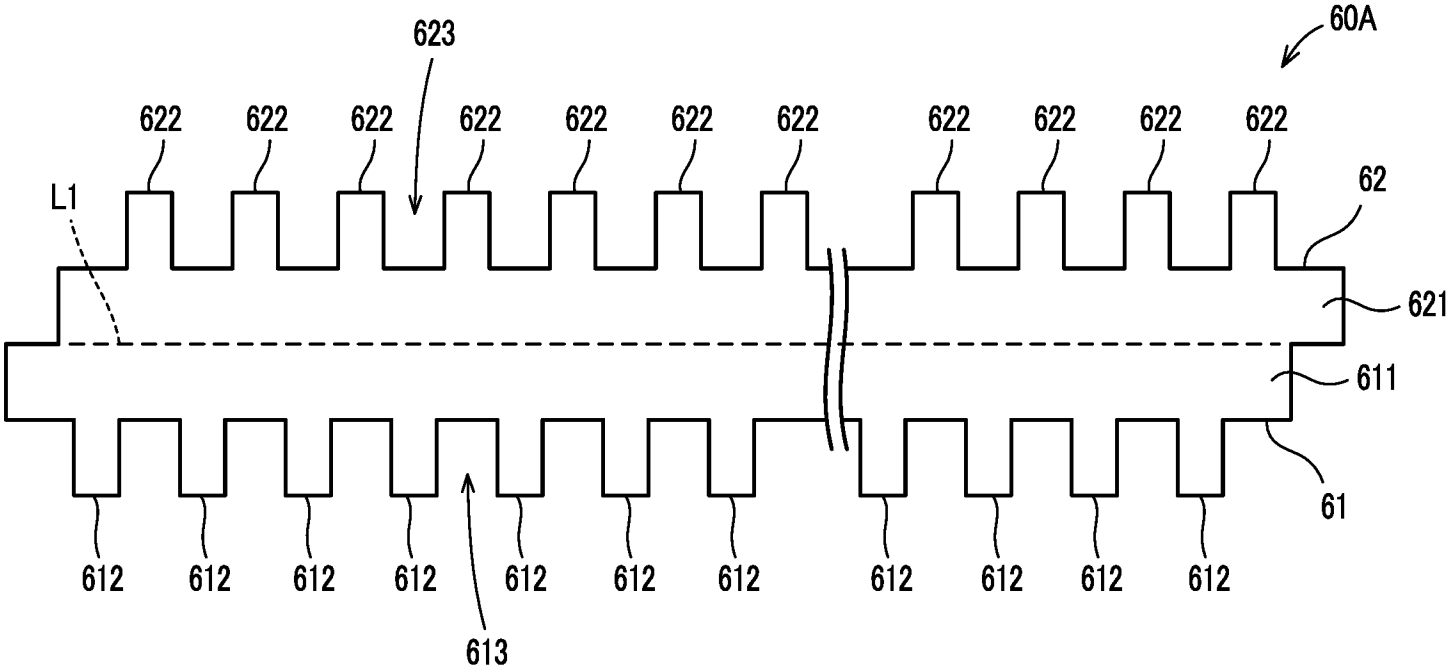
FIG. 10 is a development of a pushing member according to a third embodiment of the present disclosure.
Figure 11A:
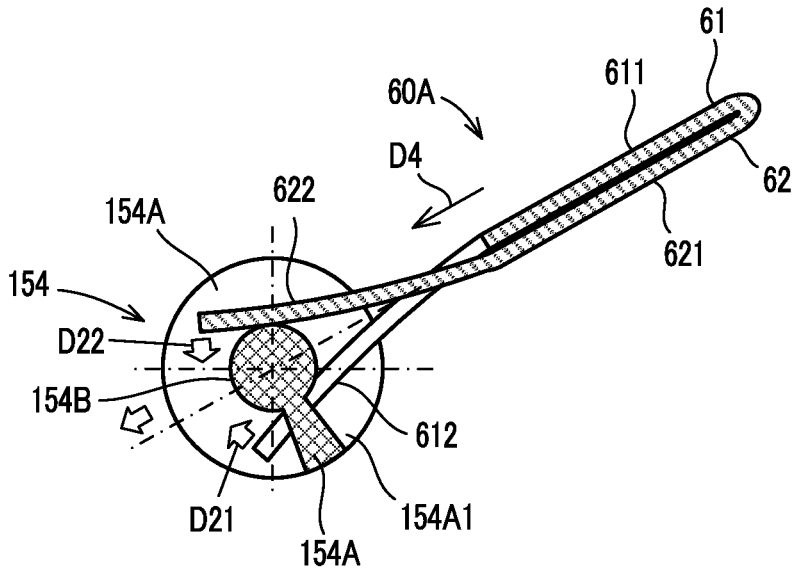
FIG. 11A is a cross-sectional view of the pushing member according to the third embodiment of the present disclosure.
Figure 11B:
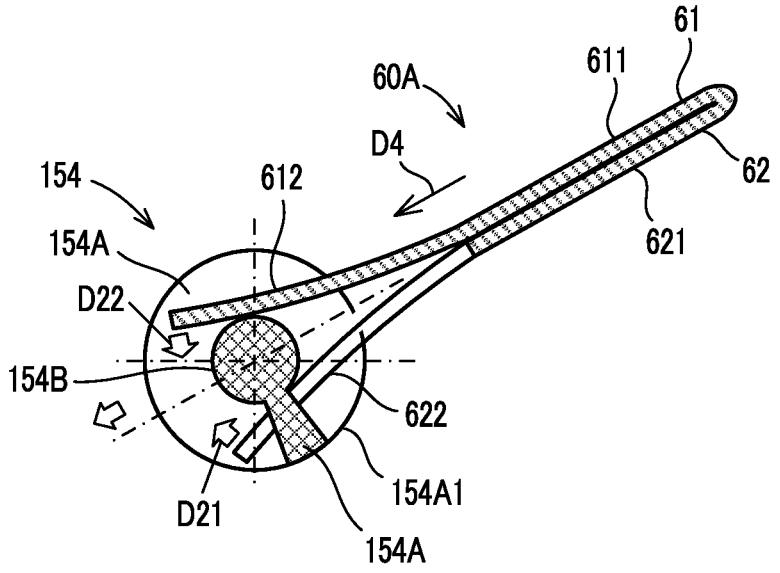
FIG. 11B is a cross-sectional view of the pushing member according to the third embodiment of the present disclosure.

As shown in FIG. 10, instead of the pushing member 60, a pushing member 60A composed of one sheet member may be provided for the drum cleaning device 15. The pushing member 60A may be composed of one sheet member that includes the upper sheet portion 61 and the lower sheet portion 62 and that is folded at a dividing line L1 between the upper sheet portion 61 and the lower sheet portion 62. In this case, the base portions 611, 621 of the folded sheet portions 61, 62, respectively, are joined to each other. Also in the pushing member 60A with the configuration above, as shown in FIG. 11A, the protruding pieces 612 may be warped so as to enter the rectangular gaps 623 between the protruding pieces 622 of the lower sheet portion 62, whereas the protruding pieces 622 may be warped so as to enter the rectangular gaps 613 between the protruding pieces 612 of the upper sheet portion 61. In addition, as shown in FIG. 11B, the pushing member 60A may include the protruding pieces 612 warped in a direction away from the lower sheet portion 62 and the protruding pieces 622 warped in a direction away from the upper sheet portion 61.

Fourth Embodiment

Figure 12:
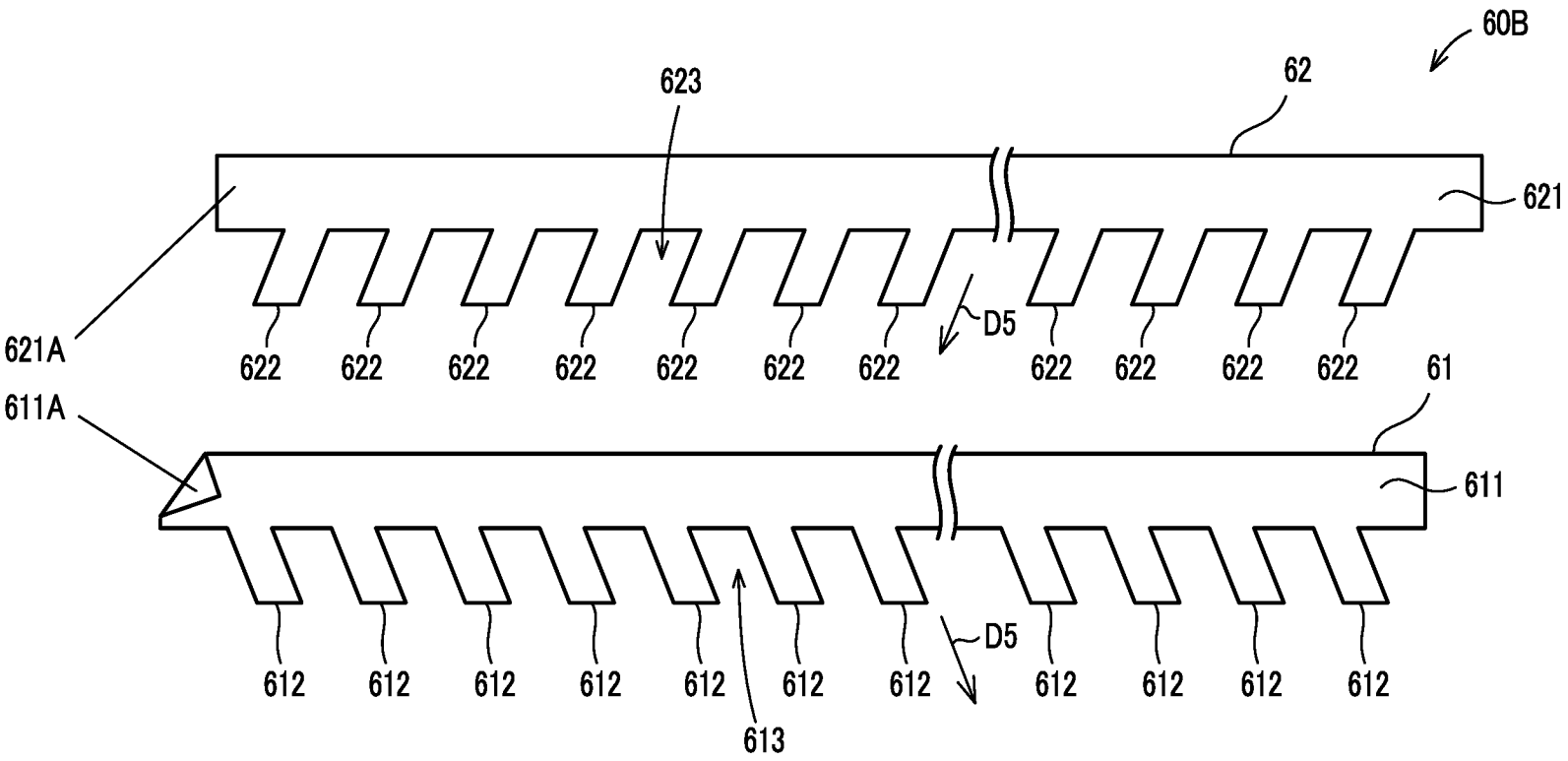
FIG. 12 is an exploded view of a pushing member according to a fourth embodiment of the present disclosure.

As shown in FIG. 12, instead of the pushing member 60, a pushing member 60B including the protruding pieces 612, 622 protruding at the same angle and in the same direction as a direction D5 (see FIG. 7A) along which the spiral blade 154A of the conveyance member 154 is inclined may be provided for the drum cleaning device 15. This configuration allows all the protruding pieces 612, 622 to abut on the outer peripheral surface 154B1 of the shaft member 154B without being interfered by the spiral blade 154A when the conveyance member 154 is in the first rotational position (see FIG. 7A). In addition, all the protruding pieces 612, 622 can abut on the outer peripheral edge 154A1 of the spiral blade 154A along the shape of the outer peripheral edge 154A1 when the conveyance member 154 is in the second rotational position (see FIG. 7B). Thus, the pushing member 60B can effectively scrape off the toner adhering to the outer peripheral surface 154B1 of the shaft member 154B and the spiral blade 154A.

Other Embodiments

In the above-described embodiments, the pushing members 60, 60A, 60B are provided for the drum cleaning device 15. However, the configurations are given for illustration and are not intended to limit the present disclosure. For example, the pushing members 60, 60A, 60B may be provided for the belt cleaning device 16 as members for scraping off toner adhering to the conveyance member 25 of the belt cleaning device 16. In addition, the pushing members 60, 60A, 60B may be provided for the developing device 13 as members for scraping off toner adhering to the stirring screws 133, 134 of the developing device 13. In addition, the pushing members 60, 60A, 60B may be provided for the toner supply device as scraping members applied to a conveyance member included in the toner supply device that supplies unused toner from the toner container 21 to the developing device 13.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner conveying device comprising:

a case that can store therein toner to be conveyed;

a conveyance member rotatably supported at both ends thereof by the case and configured to rotate to convey the toner inside the case in a conveying direction set in advance; and a pushing member pushed against the conveyance member and configured to slide on an outer peripheral portion of the conveyance member as the conveyance member rotates, wherein the pushing member includes:

a first sheet member having flexibility and abutting on the outer peripheral portion in a first direction intersecting with a rotational axis direction of the conveyance member to push the conveyance member; and a second sheet member having flexibility and abutting on the outer peripheral portion in a second direction, which is different from the first direction, intersecting with the rotational axis direction to push the conveyance member, the conveyance member includes a spiral blade extending in the rotational axis direction, the pushing member protrudes from a securing position defined inside the case toward the conveyance member, the first sheet member and the second sheet member each include:

a base portion secured at the securing position; and a plurality of protruding pieces aligned at regular intervals in the rotational axis direction and protruding from the base portion toward the conveyance member so as to be able to abut on the outer peripheral portion of the conveyance member, the protruding pieces have a width less than a separation distance between two adjacent flights of the spiral blade separated in the rotational axis direction, and the protruding pieces of the first sheet member and the protruding pieces of the second sheet member are shifted from each other in the rotational axis direction.

2. The toner conveying device according to claim 1, wherein an alignment interval between the plurality of protruding pieces is identical to a pitch of the spiral blade.

3. The toner conveying device according to claim 1, wherein the first sheet member and the second sheet member push the outer peripheral portion of the conveyance member using restoring force generated as the protruding pieces of the first sheet member and the protruding pieces of the second sheet member are warped in directions away from each other.

4. A cleaning device comprising:

the toner conveying device according to claim 1; and a removing member configured to remove remaining toner remaining on an image-carrying member after transfer, wherein the toner conveying device is configured to convey the remaining toner removed by the removing member.

5. An image forming apparatus comprising:

the toner conveying device according to claim 1;

a developing portion configured to develop a toner image on an image-carrying member; and a transfer portion configured to transfer the toner image from the image-carrying member to a transfer member, wherein the toner conveying device is configured to convey toner from a toner storing portion that stores the toner to the developing portion.

6. A toner conveying device comprising:

a case that can store therein toner to be conveyed;

a conveyance member rotatably supported at both ends thereof by the case and configured to rotate to convey the toner inside the case in a conveying direction set in advance; and a pushing member pushed against the conveyance member and configured to slide on an outer peripheral portion of the conveyance member as the conveyance member rotates, wherein the pushing member includes:

a first sheet member having flexibility and abutting on the outer peripheral portion in a first direction intersecting with a rotational axis direction of the conveyance member to push the conveyance member; and a second sheet member having flexibility and abutting on the outer peripheral portion in a second direction, which is different from the first direction, intersecting with the rotational axis direction to push the conveyance member, and the pushing member is composed of one sheet member that includes the first sheet member and the second sheet member and that is folded at a dividing line between the first sheet member and the second sheet member.

* * * * *